United States Patent [19]

Obuchi et al.

[11] Patent Number: 4,976,182

[45] Date of Patent: Dec. 11, 1990

[54] MUSICAL SCORE DISPLAY DEVICE

[75] Inventors: Yasuji Obuchi, Nara; Akira Hamada, Osaka; Hirokatsu Akiyama, Yamatokoriyama; Yasuhisa Nakamura, Joyo, all of Japan

[73] Assignee: Sharp Kabushiki Kaisha, Osaka, Japan

[21] Appl. No.: 257,938

[22] Filed: Oct. 14, 1988

[30] Foreign Application Priority Data

Oct. 15, 1987 [JP] Japan ..... 62-159116[U]

[51] Int. Cl.[5] ..... G10G 1/04

[52] U.S. Cl. ..... 84/462; 84/470 R; 84/483 A; 84/DIG. 3; 400/116; 400/117

[58] Field of Search ..... 84/404, 423, 453, 461, 84/462, 463, 470, 483 R, 483 A, 486, DIG. 3; 400/116, 117

[56] References Cited

U.S. PATENT DOCUMENTS 4,215,343 7/1980 Ejiri et al. ..... 400/117 X 4,779,510 10/1988 Van den Abbeel ..... 84/470 R X

*Primary Examiner*—Steven L. Stephan

*Assistant Examiner*—Emanuel Todd Voeltz

[57] ABSTRACT

A musical score display device for a music score processor is formed into a rectangular platelike form so as to be detachably mounted on the processor. The device includes a cable for connecting the display device with the processor. The musical score display device may include an LCD provided with two touch sensors. By pressing the sensors, the next page or previous page of music score is displayed.

22 Claims, 4 Drawing Sheets

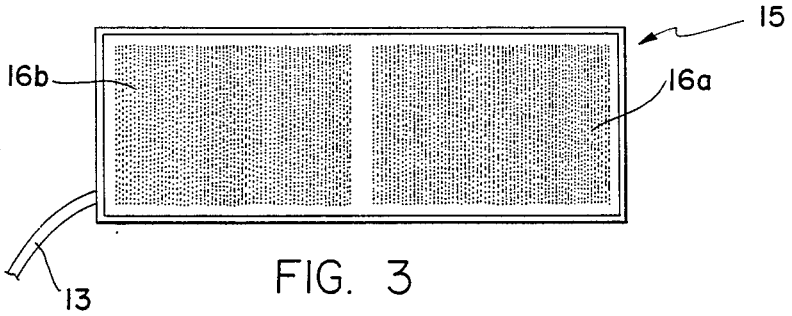
FIG. 3
FIG. 5
PRIOR ART
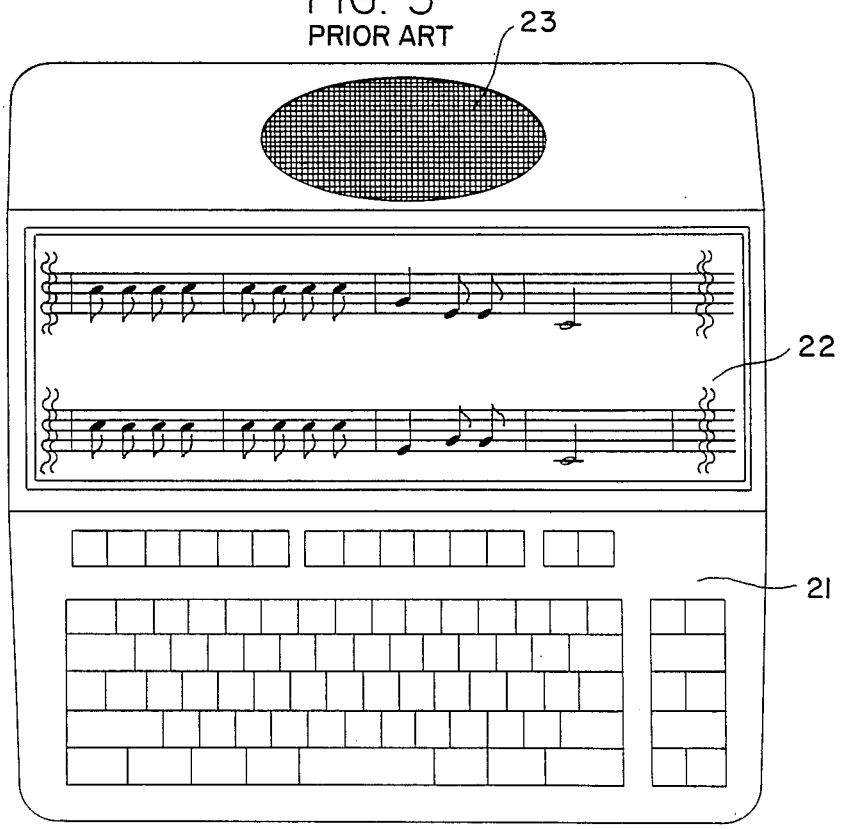

MUSICAL SCORE DISPLAY DEVICE

BACKGROUND OF THE INVENTION

1. Field of the Invention

The present invention relates to a musical score display device. More particularly, it relates to a musical score display device for a musical note input apparatus such as a so-called musical score processor in which musical score data is edited to be displayed on a display device.

2. Description of the Prior Art

An example of a conventional musical score processor is shown in FIG. 5. The processor of FIG. 5 includes a keyboard 21 having musical note keys and edit keys, a musical score display device 22 for displaying a musical score, and a speaker 23. The musical score display device 22 may be a CRT or an LCD. The display device 22 is integrally or undetachably mounted to the body of the processor. The musical score processor includes further a processing unit connected to an external memory which stores musical score fonts and other information, an output buffer memory, and an D-A converting/amplifying circuit. Musical score data inputted using the keyboard 21 and edited by the processing unit is stored into the output buffer memory, and then displayed on the display device 22 in the form of staff notation, as shown in FIG. 5. The D-A converting-/amplifying circuit converts the musical score data into an analog signal to drive the speaker 23 so that the auto-performance of the inputted musical store data is conducted.

When composing music, the user of the processor can write notes on the display 22 through the keyboard 21 and correct any of them, while listening to the auto-performance of the written notes, so that he can easily compose music matching the image which he hears.

As mentioned above, the display device 22 is undetachably mounted on the body of the musical score processor, in other words, it cannot be independently moved or used. Hence, the display device 22 cannot be placed on a music stand, unless the whole of the musical score processor, which is bulky and heavy, is mounted on a suitable pedestal such as a small table, results in that the display device cannot be used as music paper when performing a musical instrument.

On the other hand, when one plays a musical instrument while reading music paper placed on a music stand, he or an attendant must turn over the music paper one sheet after another following the progress of music. As is well known, this is very troublesome and often erroneously conducted, for example, to turn two or more pages at one time or to fail to turn over a page. Some measures, for example, tags attached music paper or sticks placed between pages have been taken, but it is impossible to dissolve these problems completely.

SUMMARY OF THE INVENTION

The musical score display device which processes music score data inputted through an input device, receiving music score data from the apparatus and displays them as music score, which overcomes the above-discussed and numerous other disadvantages and deficiencies of the prior art includes a display device which has a rectangular plate-like form so as to be detachably mounted to the input apparatus, and includes a cable for connecting the display device with the input apparatus to transmit the musical score data.

In a preferred embodiment, the display device is a liquid crystal display device.

In a further preferred embodiment, the display device is an electroluminescence display device.

In a still further preferred embodiment, the display device is a plasma display device.

In a preferred embodiment, the cable is of the retractable type.

The musical score display device for a music score input apparatus which processes music score data inputted through an input device, receiving music score data from the apparatus and displaying this data as a music score, wherein the display device has a rectangular plate-like form so as to be detachably mounted on the input apparatus, and includes two or more direction input device for inputting a control signal of displaying the next page or previous page of the musical score, and a cable for connecting the display device with the input apparatus to transmit the musical score data and said control signal.

In a preferred embodiment, the display device is an electroluminescence display device.

In further preferred embodiment, the display device is a plasma display device.

In a preferred embodiment, the cable is of the retractabe type.

Thus, the invention described herein makes possible the objectives of (1) providing a musical score display device for a musical score input apparatus which is detachable from the body of the apparatus; (2) providing a musical score display device for a musical score input apparatus which can be placed on a music stand; (3) providing a musical score display device for a musical score input apparatus which can be used as a substitute for usual music paper; and (4) providing a musical score display device for a musical score input apparatus which has a function resembling the turning over of usual music paper.

When inputting musical score into a music score input apparatus provided with the music score display device of the present invention, in a preferred embodiment, the user can input the data through the input device such as a keyboard while reading the musical score displayed on the musical score display device, in the same manner as conventional music score processors. When playing a musical instrument, the musical score display device is detached from the body of the input apparatus and placed on a music stand. The inputted musical score data is transmitted through the cable to the display device and displayed on the display device. The user can play an instrument while reading the displayed musical score.

In one embodiment of the invention, two or more direction input device means such as touch sensors are disposed on the musical score display. By operating one of the direction input device when the musical score display device displaying one page of the inputted score, the display device displays the next page of the score. By operating another direction input device, the display device displays the previous page of the score. In this way, a musical score input apparatus having the musical score display device of the invention can conduct the function similar to the turning over of usual music paper.

BRIEF DESCRIPTION OF THE DRAWINGS

This invention may be better understood and its numerous objects and advantages will become apparent to those skilled in the art by reference to the accompanying drawings as follows:

FIG. 3 illustrates another music score display device according to the invention.

FIG. 5 illustrates a conventional musical score processor.

DESCRIPTION OF THE PREFERRED EMBODIMENTS

Figure 1:
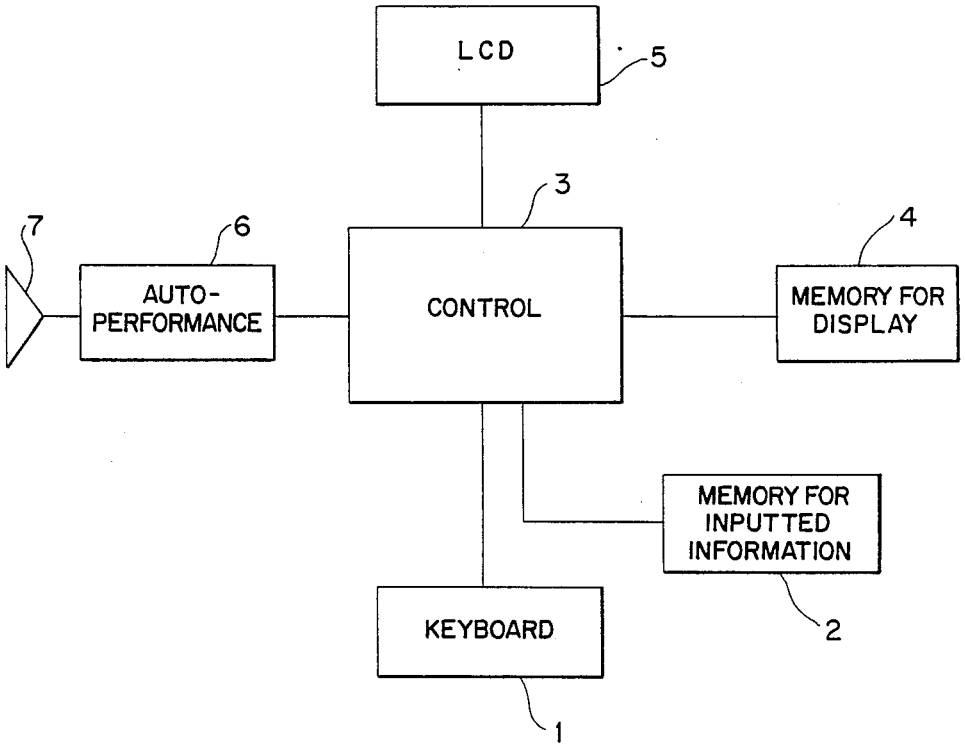
FIG. 1 is a block diagram of a music score processor provided with a musical score display device according to the invention.

FIG. 1 is a block diagram of a music score processor provided with a musical score display device according to the invention. The music score processor of FIG. 1 includes a control unit 3, a keyboard 1 connected to the control unit 3, a memory unit 2 for storing inputted information, an LCD 5, and an auto-performance unit 6 to which a speaker 7 is connected. The keyboard 1 has musical note keys and edit keys for inputting musical notes. Inputted musical score data are stored in the memory unit 2. The control unit 3 has a memory for storing music score fonts and programs to edit the inputted musical score data in accordance with instructions inputted via the keyboard 1. The musical score data which has been edited to be displayed is stored in a display memory unit 4. The LCD 5 is formed into a rectangular plate and functions as a musical score display device and displays one page of the edited musical score data which are stored in the display memory unit 4. The auto-performance unit 6 converts the edited musical score data into analog signals and amplifies them to drive the speaker 7.

Figure 2:
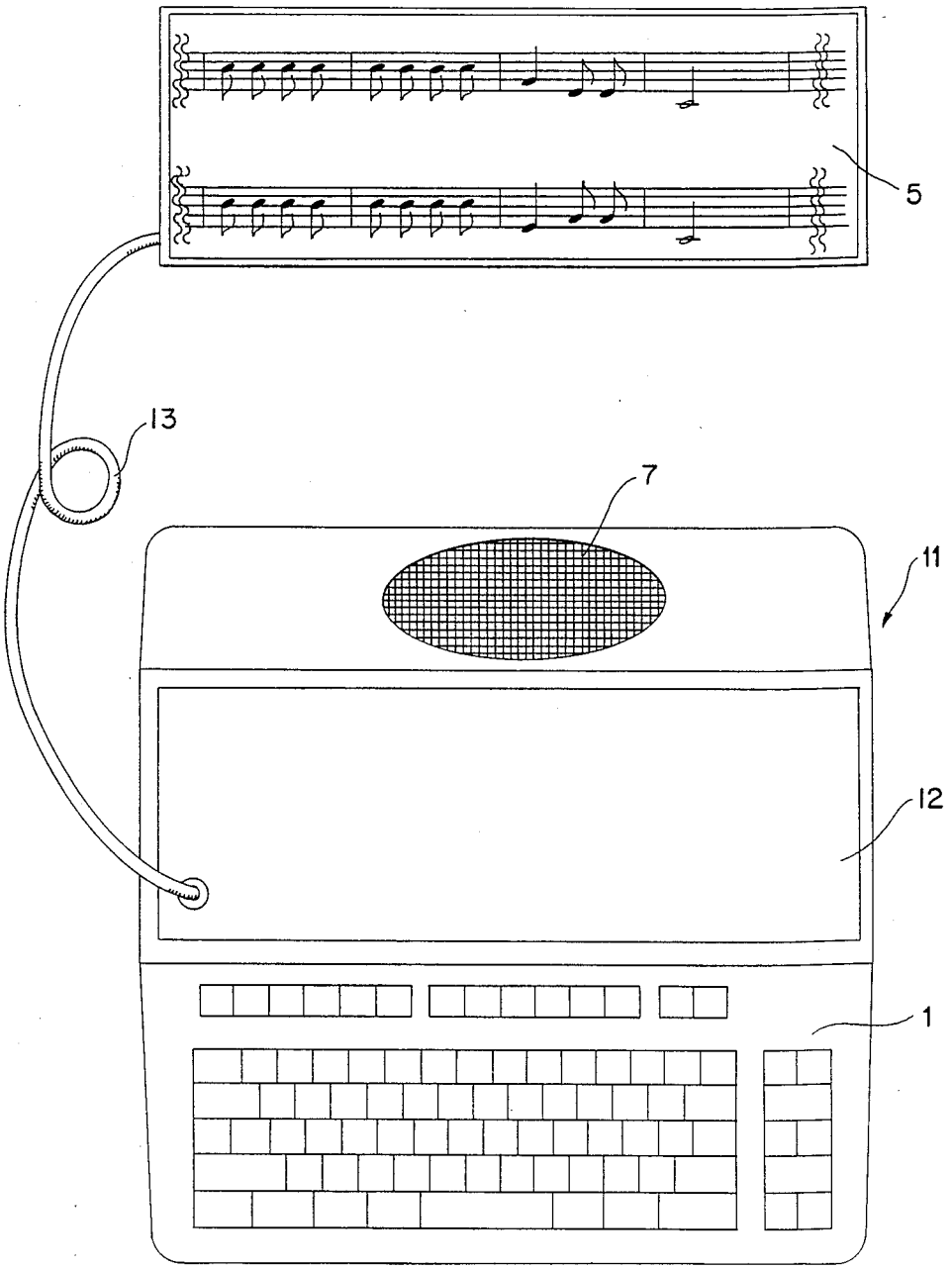
FIG. 2 illustrates the processor of FIG. 1 in which the LCD is detached.

As shown in FIG. 2, the keyboard 1 and speaker 7 are disposed on the body 11 of the processor. A recess 12 into which the LCD 5 can be fitted is formed between the keyboard 1 and the speaker 7. The LCD 5 is connected to the body 11 of the processor by a cable 13 which is pulled by a spring (not shown) in the body 11 and can be reeled into the body 11. When using the LCD 5, the cable 13 is pulled out from the body 11 to a desired length, and is locked by a known locking device. The LCD 5 is small and light so that it can be placed on a music stand in place of usual music paper.

When the musical score processor is used for inputting musical score data or for auto-performance of inputted data, the cable 13 is unlocked and reeled into the body 11, and then the LCD 5 is fitted into the recess 12. While reading the musical score displayed on the LCD 5, the user inputs musical score data by operating note keys or the like provided on the keyboard 1, and the thereafter he can listen to the auto-performance of the musical score data thus inputted, through the speaker 7. This close and integral arrangement of the LCD 5 and the keyboard 1 enables the user to promptly operate keys while seeing the inputted muscial score data, thereby facilitating the operation for data input and auto-performance.

When the user wishes to use the LCD 5 in place of usual musical paper, the LCD 5 is detached from the body 11. Thus, the cable 13 is reeled out from the body 11 so that the LCD 5 can be moved separately from the body 11, and then the LCD 5 is placed on a music stand. The user can play an instrument while reading the muscial score displayed on the LCD 5. The rectangular plate-shaped form, smallness and light weight of the LCD allow the easy placement of the LCD 5 on a music stand. Moreover, since the cable 13 is of the retractable and lockable type, the LCD 5 can be handled easily in substantially the same manner as usual musical paper.

FIG. 3 shows a musical score processor provided with another musical score display device according to another embodiment of the invention. This example can conduct a function which is smaller to the turning over of pages in usual musical paper, in order to eliminate the problems of the prior art that the turning over of musical paper is troublesome and often conducted erroneously. The LCD 15 in the example is provided with two rectangular touch sensors **16*a* and 16*b*. When the touch sensor 16*a* disposed in the right side of the LCD 15 is pressed, a forward signal is transmitted to the control unit 3 (FIG. 1). When the touch sensor 16*b* disposed in the left side of the LCD 15 is pressed, a backward signal is transmitted to the control unit 3. According to forward and backward signals, the control unit 3 reads out from the memory unit 4** image data for respectively displaying the next page or previous page of the inputted musical score.

Figure 4:
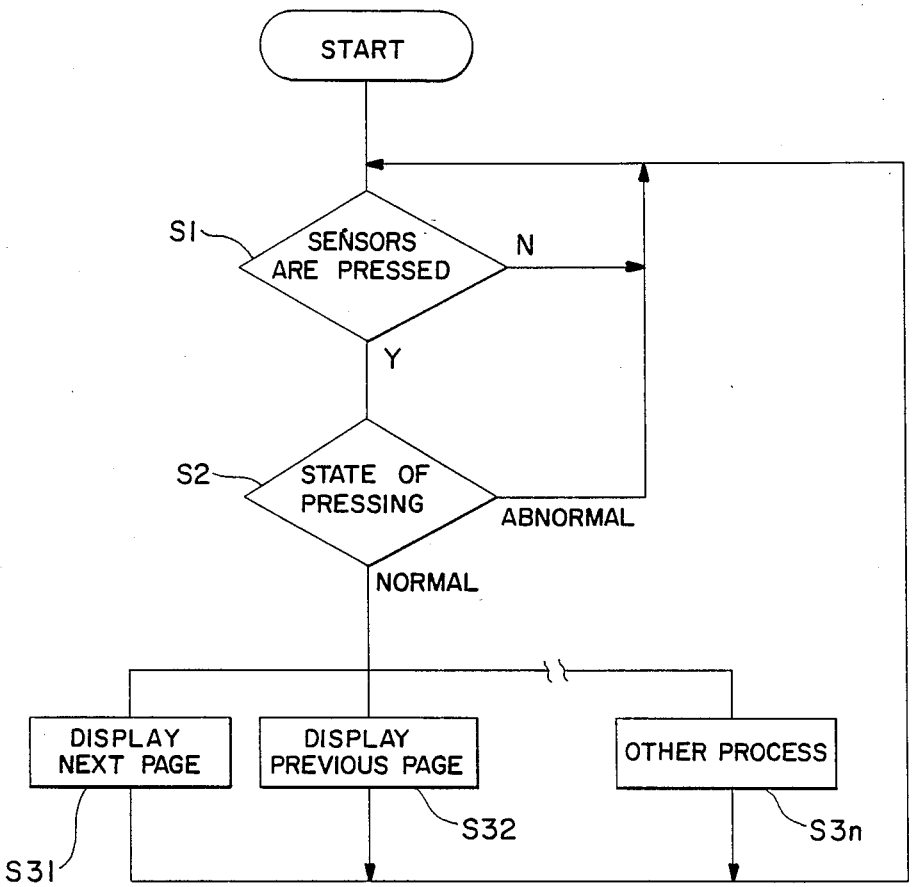
FIG. 4 is a flow chart of the processor of FIG. 1.

Referring to FIG. 4, the operation of the processor having the LCD 15 will be described more specifically. In the step S1, the control unit 3 receives the signals supplied from the touch sensors **16*a* and 16*b* to judge whether the sensors are pressed or not. When either or both of the sensors are pressed, the process proceeds to the step S2, and, when neither of the sensors is pressed, step S1** is repeated.

In the step S2, the control unit 3 judges the state of pressing the sensors, namely, whether or not only one of the sensors **16*a* and 16*b* is pressed, and whether or not the time of pressing the sensor is greater than the prefixed time. When the states are normal, the process proceeds to the step S3, i.e., one of the steps S31, S32 and S3*n*. When the sensor 16*a* is touched, the next page of the inputted musical score is displayed on the LCD 15 (step S31). When the sensor 16*b* is pressed, the previous page of the inputted musical score is displayed on the LCD 15 (step S32). When another touch sensor (not shown) disposed on the LCD 15 is touched, another appropriate procedure is conducted (step S3*n***).

When the state of pressing the sensors is judged as abnormal in step S2, the process returns to the step S1, and, if necessary, the reason for the abnormality may be displayed on the LCD 15.

In the above-described example, the displayed page of the musical score can be easily replaced with the next page or the previous page only by pressing one of the sensors disposed on the display. Accordingly, the turning over of pages of musical paper can be conducted more rapidly and surely than the manual turning over in the prior art. Therefore, the musical score display device is very useful in the performance of music. The number of the touch sensors may be more than three, and the touch sensors may be formed into another shape.

In the above-description, LCDs are exemplified as the music score display device of the invention. Other display device which can be formed into a flat shape, such as an EL display device or plasma display device may be used as the music score display device. The musical score display device may be mounted in another manner on an musical score input apparatus. A computer of the like may be used as the music score input apparatus.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A detachable musical score display device for a music score input apparatus which processes music score data inputted through an input device:

said detachable musical score display device receiving music score data from the music score input apparatus and displaying said music score data as a music score; and said detachable musical score display device having a rectangular plate-like form so as to be detachably mounted to the music score input apparatus and including a cable for detachably connecting the detachable musical score display device with the musical score input apparatus to transmit the music score data.

2. A device according to claim 1, wherein said detachable musical score display device is a crystal display device.

3. A device according to claim 1, wherein said detachable musical score display device is an electroluminescent display device.

4. A device according to claim 1, wherein said detachable musical score display device is a plasma display device.

5. A device according to claim 1, wherein said cable is of a retractable type.

6. A detachable musical score display device for a music score input apparatus which processes music score data inputted through an input device:

said detachable musical score display device receiving music score data, including pages, from the music score apparatus and displaying said music score data as a music score; and said detachable musical score display device having a rectgangular plate-like form so as to be detachably mounted to said musical score input apparatus and including two or more direction input means for inputting a control signal to control displaying of a next page or a previous page of said musical score, and further including a cable for connecting said detachable musical score display device with said music score input apparatus to transmit said musical score data and said control signal.

7. A device according to claim 6, wherein said detachable musical score display device is an electroluminescent display device.

8. A device according to claim 6, wherein said detachable musical score display device is a plasma display device.

9. A device according to claim 6, wherein said cable is of a retractable type.

10. An apparatus for displaying music score data, comprising:

a main body including, input means for inputting music data, and processing means, operatively connected to said input means, for processing said music data, said processed music data being music score data; and display means, separately mountable from said main body and operatively connected to said processing means, for displaying music score data, said display means being separable such that said display means, separated from said main body, may be placed on a music stand for observation by a user.

11. The apparatus of claim 10, wherein said display means is operatively connected to said processing means of said main body by means of cable, said cable providing a means of transferring said music score data from said processing means to said display means.

12. The apparatus of claim 11, wherein said cable is of a retractable type.

13. The apparatus of claim 10, wherein said display means is a liquid crystal display device.

14. The apparatus of claim 10, wherein said display means is an electroluminescent display device.

15. The apparatus of claim 10, wherein said display means is a plasma display device.

16. The apparatus of claim 10, further comprising:

memory means, operatively connected to said processing means, for sequentially storing said music score data in sequential pages;

said display means, operatively connected to said memory means, displaying a page of music score data.

17. The apparatus of claim 16, wherein said display means includes, plural pagination means, operatively connected to said memory means, each for accessing one of a previous and subsequent page of music score data from said memory means, respectively, upon actuation by a user;

said display means subsequently displaying said accessed one of said previous and subsequent page of music score data from said memory means for observation by a user to thereby stimulate turning of plural pages of music.

18. The apparatus of claim 17, wherein said display means is operatively connected to said memory means of main body by means of cable, said cable providing a means of transferring each said page of music score data to said display means.

19. The apparatus of claim 18, wherein said cable is of a retractable type.

20. The apparatus of claim 18, wherein said display means is a liquid crystal display device.

21. The apparatus of claim 18, wherein said display means is a electroluminescent display device.

22. The apparatus of claim 18, wherein said display means is a plasma display device.

* * * * *